US005404146A

United States Patent [19]

Rutledge

[11] Patent Number: 5,404,146

[45] Date of Patent: Apr. 4, 1995

[54] HIGH-GAIN BROADBAND V-SHAPED SLOT ANTENNA

[75] Inventor: David B. Rutledge, Pasadena, Calif.

[73] Assignee: TRW Inc., Redondo Beach, Calif.

[21] Appl. No.: 916,814

[22] Filed: Jul. 20, 1992

[51] Int. Cl.[6] ..... H01Q 1/00; H01Q 13/10

[52] U.S. Cl. ..... 343/720; 343/770; 343/771

[58] Field of Search ..... 343/720, 725, 701, 731, 343/735, 736, 767, 770; 250/336.1, 338.1

[56] References Cited

U.S. PATENT DOCUMENTS

| | | | |
|---|---|---|---|
| 2,570,824 | 10/1951 | Lindenblad | 343/767 |
| 4,242,685 | 12/1980 | Sanford | 343/770 |
| 4,644,343 | 2/1987 | Schneider et al. | 343/767 |
| 4,766,440 | 8/1988 | Gegan | 343/700 |
| 4,843,403 | 6/1989 | Lalezari et al. | 343/767 |
| 4,853,704 | 8/1989 | Diaz | 343/767 |
| 4,855,749 | 8/1989 | DeFonzo | 343/767 |
| 4,922,262 | 5/1990 | Chow | 343/770 |
| 5,036,335 | 7/1991 | Jairam | 343/767 |
| 5,070,340 | 12/1991 | Diaz | 343/767 |
| 5,166,697 | 11/1992 | Viladevall et al. | 343/770 |

*Primary Examiner*—Donald Hajec
*Assistant Examiner*—Tan Ho

[57] ABSTRACT

A nonresonant, traveling-wave V-shaped slot antenna providing high gain and a broad bandwidth for coupling infrared radiation onto a detector. The V-shaped slot antenna includes a relatively thick dielectric substrate and a metallization layer formed on the substrate. The metallization layer includes a pair of slots positioned at an angle $\phi_1$ to form a V-shaped slot. The slot angle $\phi_1$ is equal to approximately twice the radiation angle $\psi$, which is defined as the arccos of $v_d/v_s$, where $v_s$ is the propagation velocity of the infrared radiation in the two slots and $v_d$ is the propagation velocity of the radiation in the dielectric substrate. At the slot angle $\phi_1$, the radiation in the two slots adds in phase to produce a single high-gain beam along the V axis.

11 Claims, 3 Drawing Sheets

HIGH-GAIN BROADBAND V-SHAPED SLOT ANTENNA

BACKGROUND OF THE INVENTION

This invention relates generally to slot antennas and, more particularly, to slot antennas fabricated on relatively thick dielectric substrates.

Semiconductor infrared detectors are often arranged in focal plane arrays and cryogenically cooled to very low temperatures to provide sensitive detection of infrared radiation for various types of space-based sensor systems. These detectors are usually made as small as possible to not only increase the sensitivity and speed of each detector, but also to increase the sensitivity of the entire array by allowing more detectors to be placed in the array. However, it is difficult to couple infrared radiation directly onto a detector that is smaller than about a wavelength of the radiation. Therefore, a small antenna is often used to couple the incident infrared radiation onto the detector.

Infrared detector arrays are typically fabricated on dielectric substrates, such as silicon or quartz, using integrated-circuit fabrication methods, and the antennas are typically fabricated as thin metal film patterns on the substrates. Several types of antennas are often used, such as bow-tie antennas or slot antennas. However, these types of antennas tend to have low gains and poor radiation patterns. One alternative is to make the dielectric substrate very thin, on the order of $\lambda/100$, thus preventing large energy losses in the dielectric substrate. However, thin substrates on the order $\lambda/100$ are very difficult to fabricate for infrared wavelengths. Another alternative is to add a superstrate to the dielectric substrate so that the antenna is entirely inside the dielectric, thus increasing the gain. However, the gap between the superstrate and the substrate must be exceedingly small, on the order of $\lambda/100$, which is also difficult to fabricate for infrared wavelengths. Accordingly, there has been a need for a high-gain, broadband antenna that is easily fabricated on dielectric substrates. The present invention is directed to this end.

SUMMARY OF THE INVENTION

The present invention resides in a nonresonant, traveling-wave V-shaped slot antenna providing high gain and a broad bandwidth for coupling infrared radiation onto a detector. The V-shaped slot antenna includes a relatively thick dielectric substrate and a metallization layer formed on the substrate. The metallization layer includes a pair of slots positioned at an angle $\phi_1$ to form a V-shaped slot. The slot angle $\phi_1$ is equal to approximately twice the radiation angle $\psi$, which is defined as the arccos of $v_d/v_s$, where $v_s$ is the propagation velocity of the infrared radiation in the two slots and $v_d$ is the propagation velocity of the radiation in the dielectric substrate. At the slot angle $\phi_1$, the radiation in the two slots adds in phase to produce a single high-gain beam along the V axis.

The single high-gain beam is detected by an infrared detector positioned at the apex of the V-shaped slot. The detector generates a voltage which is proportional to the power of the incident infrared radiation. A coplanar waveguide, which is formed by a pair of parallel slots extending from the base of the V-shaped slot, provides a low frequency output for the detector voltage. The coplanar waveguide includes an outer metallization layer, which is the ground plane of the waveguide, and an inner metallization layer, which is the conductor of the waveguide.

The V-shaped slot antenna of the present invention operates based on wave propagation along a conductor at the interface between air and a dielectric substrate. A wave along a conductor at the interface, in this case the slot, tends to propagate at a velocity that is intermediate between the velocity of the wave in air and the velocity of the wave in the dielectric material. Because the propagation velocity of the wave in the dielectric substrate is slow compared to the propagation velocity of the wave in air, mostly evanescent waves are excited in the air. Therefore, little power radiates into the air. However, the propagation velocity of the wave in the slot is fast compared to the propagation velocity of the wave in the dielectric substrate. Therefore, the wave radiates strongly into the dielectric material in the shape of a cone at the radiation angle $\psi$. The slots produce a pair of these cone-shaped radiation patterns which add together in phase to produce a single high-gain beam along the V axis.

It will be appreciated from the foregoing that the present invention represents a significant advance in the field of slot antennas. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
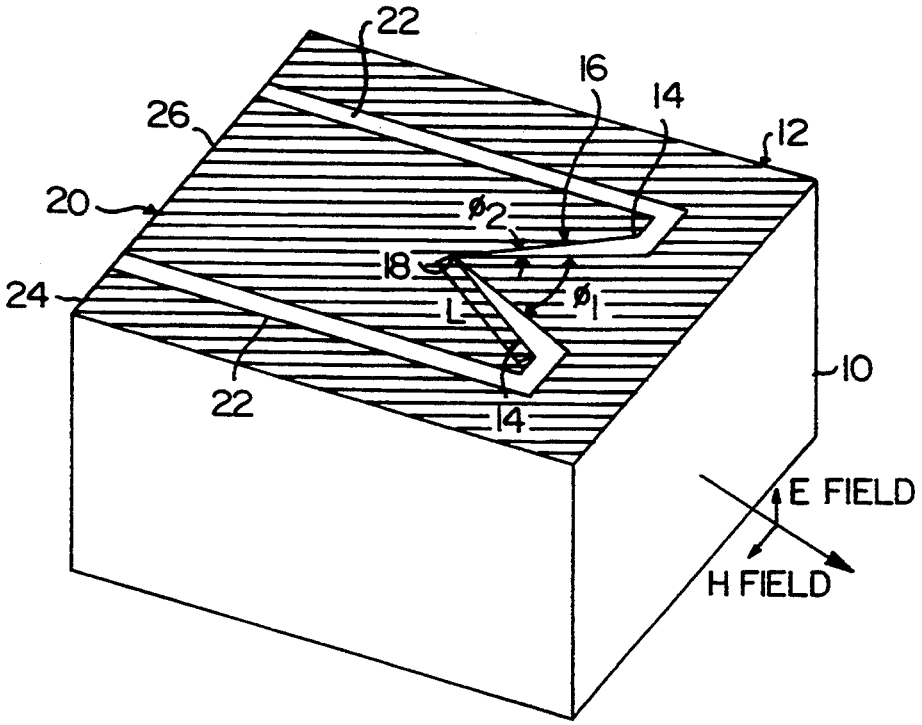
FIG. 1 is a perspective view of a high-gain broadband V-shaped slot antenna in accordance with the present invention.
Figure 2:
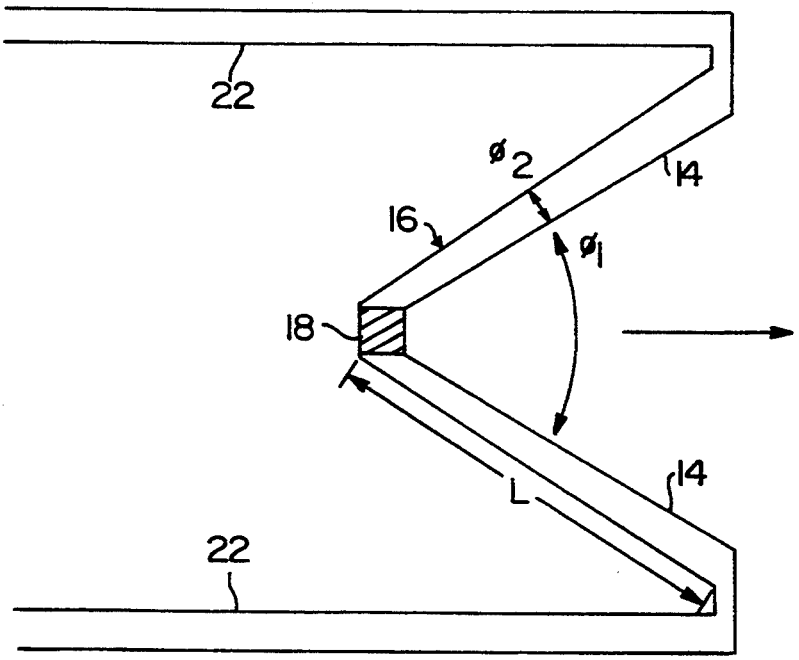
FIG. 2 is a schematic view of the high-gain broadband V-shaped slot antenna of the present invention.

As shown in the drawings for purposes of illustration, the present invention is embodied in a nonresonant, traveling-wave V-shaped slot antenna providing high gain and a broad bandwidth for coupling infrared radiation onto a detector. As shown in FIGS. 1 and 2, the V-shaped slot antenna includes a relatively thick dielectric substrate 10 and a metallization layer 12 formed on the substrate. The metallization layer 12 includes a pair of slots 14 positioned at an angle $\phi_1$ to form a V-shaped slot 16. The slot angle $\phi_1$ is equal to approximately twice the radiation angle $\psi$, which is defined as the arccos of $v_d/v_s$, where $v_s$ is the propagation velocity of the infrared radiation in the two slots 14 and $v_d$ is the propagation velocity of the radiation in the dielectric substrate 10. At the slot angle $\phi_1$, the radiation in the two slots 14 adds in phase to produce a single high-gain beam along the V axis.

The single high-gain beam is detected by an infrared detector 18 positioned at the apex of the V-shaped slot 16. The detector 18 generates a voltage which is proportional to the power of the incident infrared radiation. A coplanar waveguide 20, which is formed by a pair of parallel slots 22 extending from the base of the V-shaped slot 16, provides a low frequency output for the detector voltage. The coplanar waveguide 20 includes an outer metallization layer 24, which is the ground plane of the waveguide 20, and an inner metallization layer 26, which is the conductor of the waveguide.

The V-shaped slot antenna of the present invention operates based on wave propagation along a conductor at the interface between air and a dielectric substrate 10. A wave along a conductor at the interface, in this case the slot 14, tends to propagate at a velocity that is intermediate between the velocity of the wave in air and the velocity of the wave in the dielectric material. Because the propagation velocity of the wave in the dielectric substrate 10 is slow compared to the propagation velocity of the wave in air, mostly evanescent waves are excited in the air. Therefore, little power radiates into the air. However, the propagation velocity of the wave in the slot 14 is fast compared to the propagation velocity of the wave in the dielectric substrate 10. Therefore, the wave radiates strongly into the dielectric material in the shape of a cone at the radiation angle $\psi$. The slots 14 produce a pair of these cone-shaped radiation patterns which add together in phase to produce a single high-gain beam along the V axis.

Figure 3:
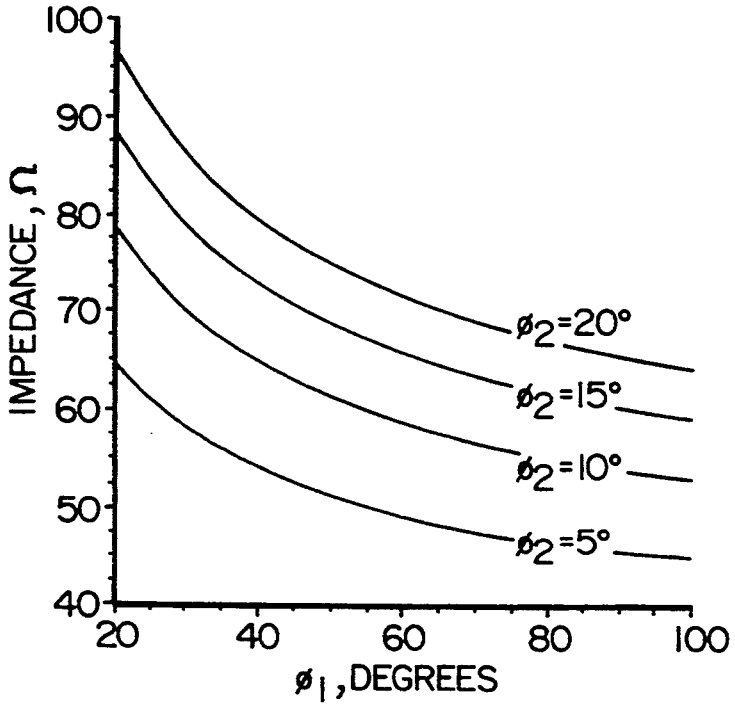
FIG. 3 is a graph of the impedance of the high-gain broadband V-shaped slot antenna of the present invention.
Figure 4:
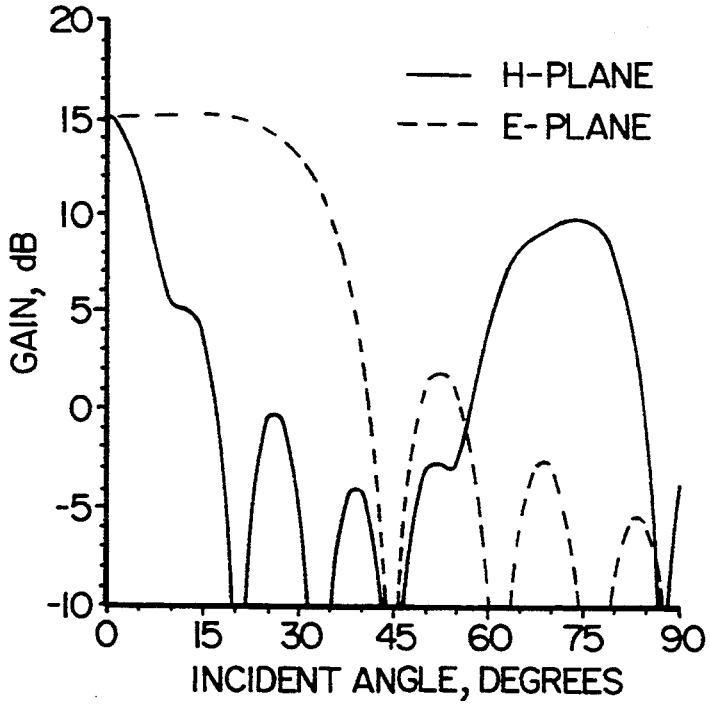
FIG. 4 is a graph of the calculated E-plane and H-plane radiation patterns for the high-gain broadband V-shaped slot antenna of the present invention.

FIG. 3 is a graph of the impedance of the V-shaped slot antenna, which is calculated as a function of the slot angle $\phi_1$ for several different angles $\phi_2$ of the slot itself. The impedance of the slot antenna is on the order of 50 to 80 Ω for most angles, and is relatively constant over about two octaves. FIG. 4 is a graph of the E-plane (elevation) and H-plane (azimuth) radiation patterns, which are calculated as a function of the incident angle. The calculated gain along the V axis is 15 dB and the 3 dB beamwidth is 64° in the E-plane and 10° in the H-plane. There is a 5 dB sidelobe at 75° in the E-plane. The E-plane radiation pattern is a broad asymmetrical pattern with a peak gain biased downward into the dielectric substrate 10 due to a finite ground plane, as shown in FIG. 1. The H-plane radiation pattern is much narrower than the E-plane pattern and has a centered peak.

Figure 5A:
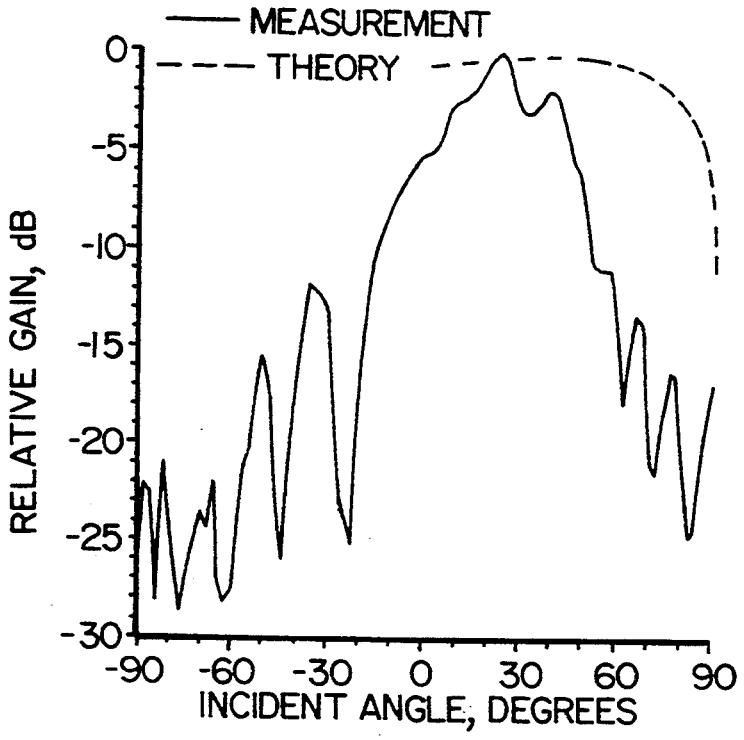
FIGS. 5*a* and 5*b* are graphs of the measured and calculated E-plane and H-plane radiation patterns of the high-gain broadband V-shaped slot antenna of the present invention.
Figure 5B:
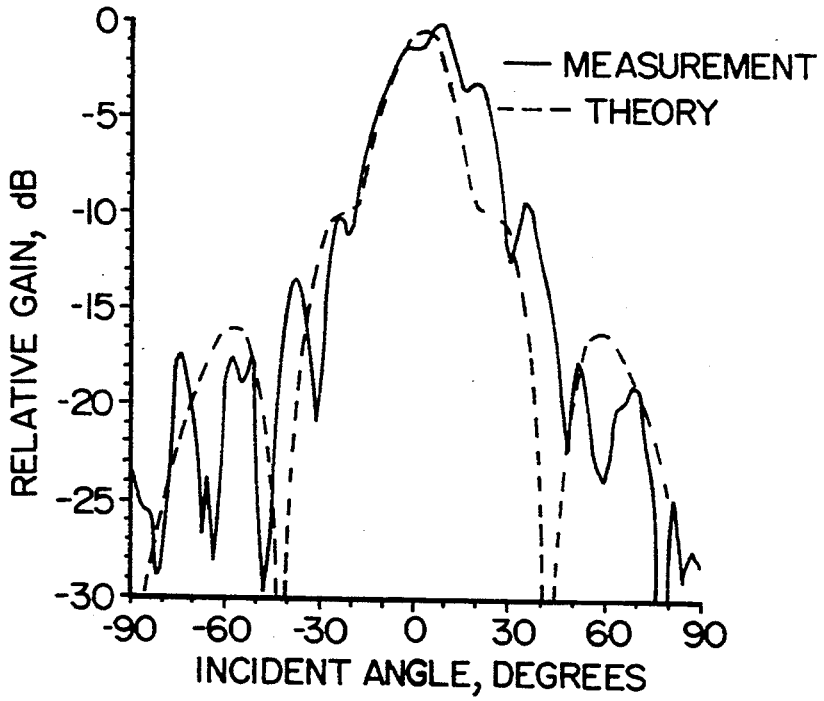

FIGS. 5*a* and 5*b* are graphs of the measured E-plane (elevation) and H-plane (azimuth) radiation patterns for a 90 GHz signal, which are compared with the calculated radiation patterns. As shown in FIG. 5*a*, the V-shaped slot antenna is much more sensitive in the E-plane to radiation incident from the dielectric substrate 10. The peak gain of the E-plane radiation pattern is 20° into the dielectric substrate 10 and decays much faster than theory predicts. As shown in FIG. 5*b*, theory and experiment agree for the H-plane radiation pattern. The H-plane radiation pattern is measured at 20° in the E-plane, where the gain is a maximum.

In many applications, it is desirable that the E-plane and H-plane beamwidths be approximately the same for efficient coupling into the infrared detector 18. A cylindrical lens can be used to equalize the two beamwidths by reducing the E-plane beamwidth without changing the H-plane beamwidth.

In a preferred embodiment of the present invention, the V-shaped slot antenna is fabricated on a fused quartz substrate. The length L of each slot 14 is 5λ, the slot angle $\phi_1$ is 57.5°, and the angle $\phi_2$ of each slot is 10°. The dielectric substrate 10 is 25 mm by 25 mm with a thickness of 14 mm. The dielectric substrate 10 should be on the order of a wavelength or thicker. As the dielectric substrate is made thinner, the propagation velocity $v_d$ in the dielectric material is increased. If the dielectric substrate is made too thin, then the beam radiates out of the substrate and a split beam results. The metallization layer 12 preferably includes an upper layer of gold having a thickness of 1600 Å and a lower layer of chromium having a thickness of 120 Å. The metallization layer 12 can also be aluminum, copper or any other suitable metal. The metallization layer 12 is deposited by conventional electrochemical deposition techniques and the slots 14 are formed by conventional photoetching techniques.

The V-shaped slot antenna of the present invention operates as a receiver or transmitter, and operates in the microwave, millimeter and submillimeter wavelengths as well as the infrared wavelengths. Because of the broad bandwidth and high gain characteristics of the V-shaped slot antenna, the antenna should provide picosecond optoelectronic measurements.

From the foregoing, it will be appreciated that the present invention represents a significant advance in the field of slot antennas. Although a preferred embodiment of the invention has been shown and described, it will be apparent that other adaptations and modifications can be made without departing from the spirit and scope of the invention. Accordingly, the invention is not to be limited, except as by the following claims.

I claim:

1. A V-shaped slot antenna, comprising:

a dielectric substrate; and a metallization layer formed on the dielectric substrate, the metallization layer having a V-shaped slot formed by a pair of slots positioned at an angle wherein the slot antenna is a nonresonant, traveling-wave antenna having a slot angle $\phi_1$ that is equal to approximately twice its radiation angle $\psi$, the radiation angle $\psi$ being defined as the arccos of $v_d/v_s$, where $v_s$ is the propagation velocity of the radiation in the slots and $v_d$ is the propagation velocity in the dielectric substrate, whereby the radiation in the two slots adds in phase to produce a single high-gain beam.

2. The V-shaped slot antenna as set forth in claim 1, and further including:

a detector positioned at the apex of the V-shaped slot for generating a detector-voltage that is proportional to radiation incident on the antenna and detector; and a coplanar waveguide formed by a pair of parallel slots extending from the base of the V-shaped slot to provide an output for the detector voltage.

3. The V-shaped slot antenna as set forth in claim 1, wherein the thickness of the dielectric substrate is approximately a wavelength or thicker.

4. The V-shaped slot antenna as set forth in claim 1, wherein the dielectric substrate is fused quartz, the length L of each slot is 5λ, the slot angle $\phi_1$ is approximately 57.5°, and the angle $\phi_2$ of each slot is approximately 10°.

5. The V-shaped slot antenna as set forth in claim 1, wherein the metallization layer includes an upper layer of gold and a lower layer of chromium.

6. An infrared detector, comprising:

a V-shaped slot antenna having a dielectric substrate and a metallization layer formed on the dielectric substrate, the metallization layer having a V-shaped slot formed by a pair of slots positioned at an angle $\phi_1$;

an infrared detector element positioned at the apex of the V-shaped slot for generating a detector voltage that is proportional to radiation incident on the infrared detector; and a coplanar waveguide formed by a pair of parallel slots extending from the base of the V-shaped slot to provide an output for the detector voltage;

wherein the slot antenna is a nonresonant, traveling-wave antenna having a clot angle $\phi_1$ that is equal to approximately twice its radiation angle $\psi$, the radiation angle $\psi$]being defined as the arccos of $v_d/v_s$, where $v_s$ is the propagation velocity of the radiation in the slots and $v_d$ is the propagation velocity in the dielectric substrate, whereby the radiation in the two slots adds in phase to produce a single high-gain beam.

7. The infrared detector as set forth in claim 6, wherein the thickness of the dielectric substrate is approximately a wavelength or thicker.

8. The infrared detector as set forth in claim 6, wherein the dielectric substrate is fused quartz, the length L of each slot is $5\lambda$, the slot angle $\phi_1$ is approximately 57.5°, and the angle $\phi_2$ of each slot is approximately 10°.

9. The infrared detector as set forth in claim 6, wherein the metallization layer includes an upper layer of gold and a lower layer of chromium.

10. A V-shaped slot antenna, comprising:

a dielectric substrate;

a metallization layer formed on the dielectric substrate, the metallization layer having a V-shaped slot formed by a pair of slots;

a detector positioned at the apex of the V-shaped slot for generating a detector voltage that is proportional to radiation incident on the antenna and detector; and a coplanar waveguide formed by a pair of parallel slots extending from the base of the V-shaped slot to provide an output for the detector voltage;

wherein the slot antenna is a nonresonant, traveling-wave antenna in which the propagation velocity of a radiation wave in the slot is fast compared to the propagation velocity of the wave in the dielectric substrate such that the wave radiates strongly into the dielectric material in the shape of a cone, the two slots producing a pair of these cone-shaped radiation patterns that add together in phase to produce a single high-gain beam.

11. The V-shaped slot antenna as set forth in claim 10, wherein the thickness of the dielectric substrate is approximately a wavelength or thicker.

* * * * *